US006803535B1

(12) United States Patent
Whipple et al.

(10) Patent No.: US 6,803,535 B1
(45) Date of Patent: Oct. 12, 2004

(54) CIRCUIT BREAKER WITH A VISUAL INDICATION OF A TRIP

(75) Inventors: Michael Jerome Whipple, Rochester, PA (US); Edward Ethber Lias, Aliquippa, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/782,624

(22) Filed: Feb. 19, 2004

(51) Int. Cl.[7] ..... H01H 9/00

(52) U.S. Cl. ..... 200/308; 200/330; 200/401; 335/17

(58) Field of Search ..... 200/308, 331, 200/401, 330, 400; 335/17, 18, 8, 9

(56) References Cited

U.S. PATENT DOCUMENTS 3,401,363 A 9/1968 Vyskocil et al.
3,443,258 A 5/1969 Dunham et al.
3,596,219 A * 7/1971 Erickson ..... 335/17
4,166,989 A 9/1979 Castonguay et al.
5,264,673 A * 11/1993 Powell ..... 200/401
5,694,101 A 12/1997 Lavelle et al.
5,823,323 A * 10/1998 Seymour et al. ..... 200/308
5,831,500 A 11/1998 Turner et al.
5,981,887 A 11/1999 Robarge et al.
6,107,902 A * 8/2000 Zhang et al. ..... 335/17
6,130,390 A * 10/2000 Castonguay ..... 200/308
6,380,501 B1 4/2002 Figueroa et al.

* cited by examiner

*Primary Examiner*—Kyung Lee
(74) *Attorney, Agent, or Firm*—Martin J. Moran

(57) ABSTRACT

A trip indicator of a circuit breaker is set to the tripped position through engagement by the cradle, which is unlatched by the trip mechanism. Even though the cradle is automatically reset by a reset spring, the trip member indicator is retained in the tripped position by an indicator spring. The trip indicator member is returned to the untripped position by a reset member on the circuit breaker operating member as the latter is rotated by the circuit breaker handle to the ON position. The trip indicating member is transversely displaced through an out of round pivot mount as the operating member is rotated to the off position before the cradle unlatches when the circuit breaker blows open in response to a short circuit.

21 Claims, 7 Drawing Sheets

CIRCUIT BREAKER WITH A VISUAL INDICATION OF A TRIP

BACKGROUND OF THE INVENTION

1. Field of the Invention

This invention relates to circuit breakers in general, and in particular, to circuit breakers with an indicator signaling that the circuit breaker has opened due to an abnormal condition in the protected circuit.

2. Background Information

A type of small circuit breaker, often referred to as a miniature circuit breaker, widely used in residential, light commercial and other applications, has a thermal/magnetic trip device that opens the circuit breaker contacts in response to persistent overload conditions and to short circuits. Many such miniature circuit breakers have a handle that is manually used to turn the circuit breaker off and on and that assumes a position intermediate the off and on positions to signal that the circuit breaker has tripped open. In other such miniature circuit breakers, the handle only has two positions, on and off, the latter of which is assumed when the breaker is manually turned off or when a trip occurs. Thus, in these breakers, the position of the handle does not provide a visual indication of a trip. This can make it difficult to identify a circuit breaker that has tripped among the many circuit breakers in a load center where one or more could have been manually turned off.

It is known to provide a trip flag in a miniature circuit breaker to indicate the tripped condition. Typically, the trip flag is actuated to the tripped condition by a cradle that couples the trip mechanism to the contact assembly to open the circuit breaker. Typically also, the flag is reset following a trip by relatch of the cradle through movement of the handle.

Some miniature circuit breakers automatically reset following a trip. That is, a reset spring relatches the cradle, although the contacts remain open and must be manually reset. As the relatching occurs immediately after the trip, a trip flag that is reset by the cradle would not provide any meaningful trip indication.

There is a need, therefore for an improved arrangement for displaying the trip status of a circuit breaker, and particularly of a circuit breaker that automatically relatches the cradle following a trip.

SUMMARY OF THE INVENTION

This need, and others, are satisfied by the invention which is directed to a circuit breaker that includes a trip indicator comprising a trip indicating member carrying trip indicia, such as a flag, which is moved to a tripped position where it is visible through a window in the housing of the circuit breaker by movement of the cradle to the unlatched position in response to actuation of the trip mechanism. The trip indicating member is moved back to the untripped position by movement of the circuit breaker operating member that incorporates the handle to the closed position. Thus, the trip indicator is set to the tripped position by the unlatching of the cradle, however, it is reset not by the relatching of the cradle but instead by the operating member through movement of the handle to the closed position. Although not so limited, it makes the invention useful in connection with circuit breakers in which the cradle is automatically reset following a trip. The trip indicator remains in the tripped position, even though the cradle is relatched, until the operating member is manually moved to the closed position.

The invention accommodates the blow open feature often provided on circuit breakers. The strong magnetic fields created by a short circuit cause the contact arm carrying a movable contact to swing open before the trip mechanism has time to respond. As the cradle has not yet unlatched, the trip indicator remains in the untripped position. However, the handle, being connected to the contact arm moves toward the off position. This movement of the handle toward the off position with the trip indicator in the untripped condition produces interference between the operating member and the trip indicator. In accordance with the invention, the trip indicating member is compliantly displaceable to allow the handle to be moved to the off position following a blow open. When the trip mechanism finally actuates, the cradle is unlatched and spring driven to the tripped position thereby setting the trip indicator to the tripped condition. The handle may then be repositioned to the on position to reclose the circuit breaker and at the same time reset the trip indicating member to the untripped position.

More particularly, the invention is directed to a circuit breaker comprising: a housing; a pair of contacts comprising a fixed contact and a movable contact; an operating member pivotally mounted for movement between a closed position and an open position and having a handle extending outside the housing, and a contact arm carrying the movable contact at a first end and coupled to the operating member at a second end. The circuit breaker further comprises a trip mechanism comprising a thermal/magnetic trip device having a tripped state and an untripped state, a cradle pivotally mounted for movement between a latched position in which the cradle is retained by the trip mechanism in the untripped state and an unlatched position to which the cradle moves when the trip mechanism goes to the tripped state, and an operating spring between the cradle and the contact arm biasing the contact arm to a closed state in which the movable contact engages the fixed contact when the operating member is in the closed state and the cradle is latched and otherwise biasing the contact arm to an open state in which the pair of contacts are separated. A trip indicator for the circuit breaker comprises an indicator window in the housing, a trip indicating member carrying a trip indicia, and an indicator mount mounting the trip indicating member for movement between a tripped position in which the trip indicia is visible through the indicator window and an untripped position in which the trip indicia is not visible through the indicator window. The cradle has an engagement member engaging the trip indicating member and moving the trip indicating member to the tripped position as the cradle moves to the unlatched position. The operating member has a reset member engaging and moving the trip indicating member to the untripped position as the operator is moved to the closed or on position.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
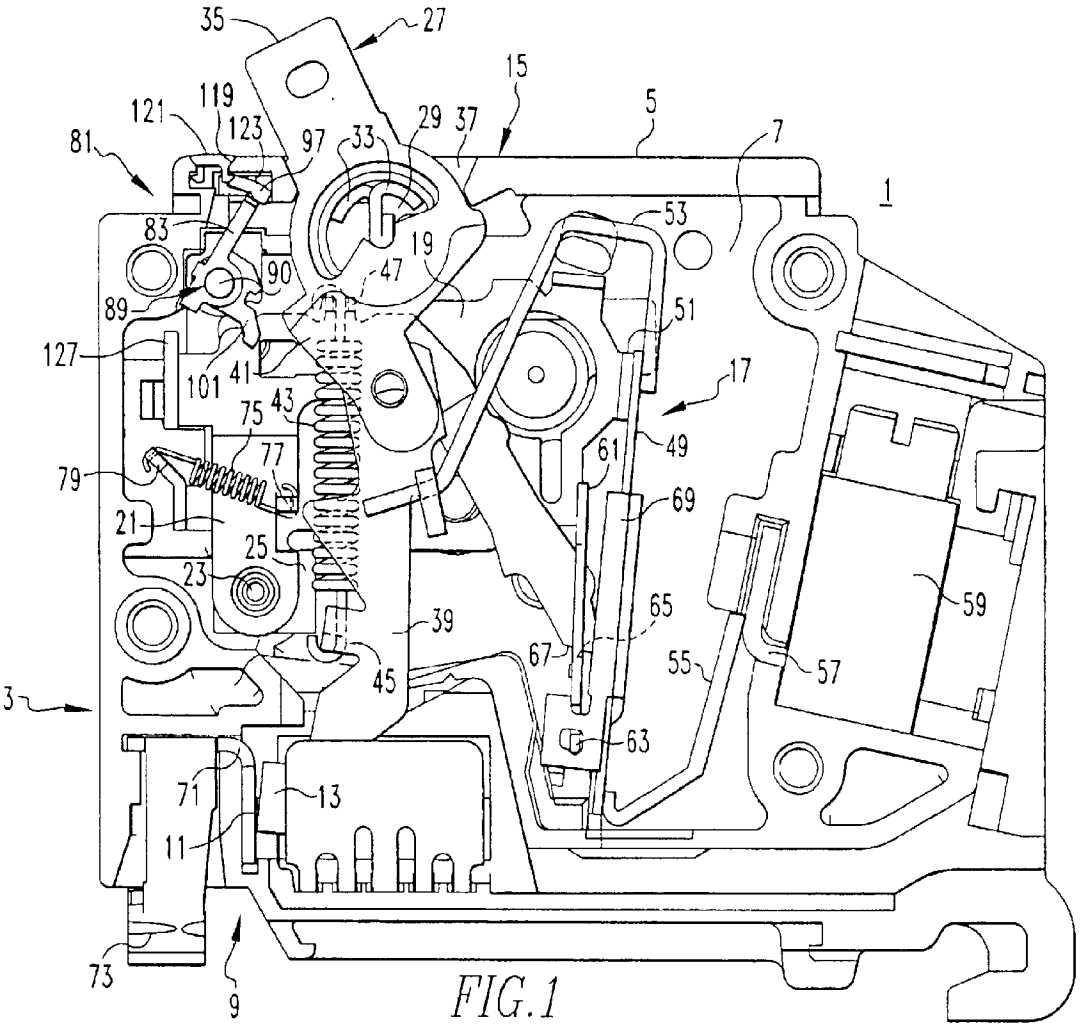
FIG. 1 is a vertical elevation view of a circuit breaker in accordance with the invention shown with the cover removed.

FIG. 1 illustrates a circuit breaker incorporating the invention. The circuit breaker 1 includes a molded housing 3 having a base 5 and a cover (not shown) forming a cavity 7 containing a pair of contacts 9 including a fixed contact 11 and a movable contact 13, an operating mechanism 15 that opens and closes the pair of contacts 9, and a trip mechanism 17. The pair of contacts 9, operating mechanism 15 and trip mechanism 17 are all preassembled on a metal frame 19 for insertion into the cavity 7 as a unit for ease of assembly. This metal frame 19 is more clearly shown in FIG. 2.

Figure 3:
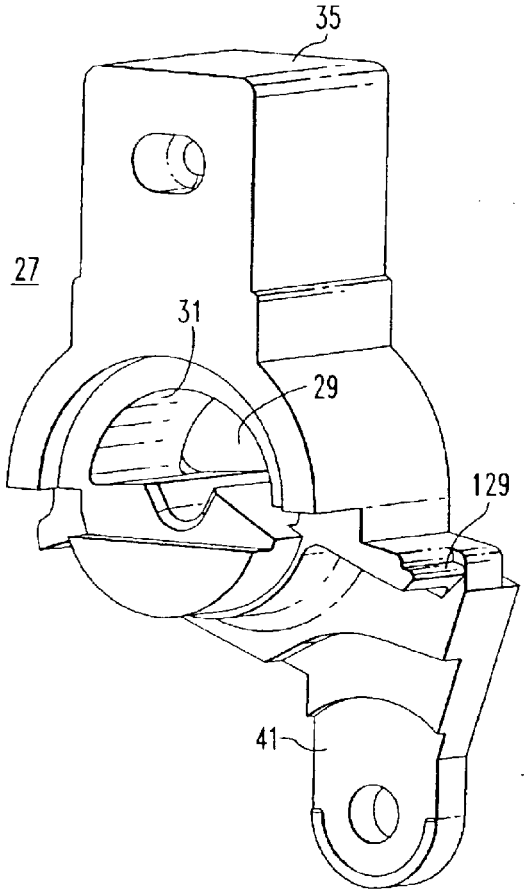
FIG. 3 is an isometric view of the circuit breaker operating member.
Figure 5:
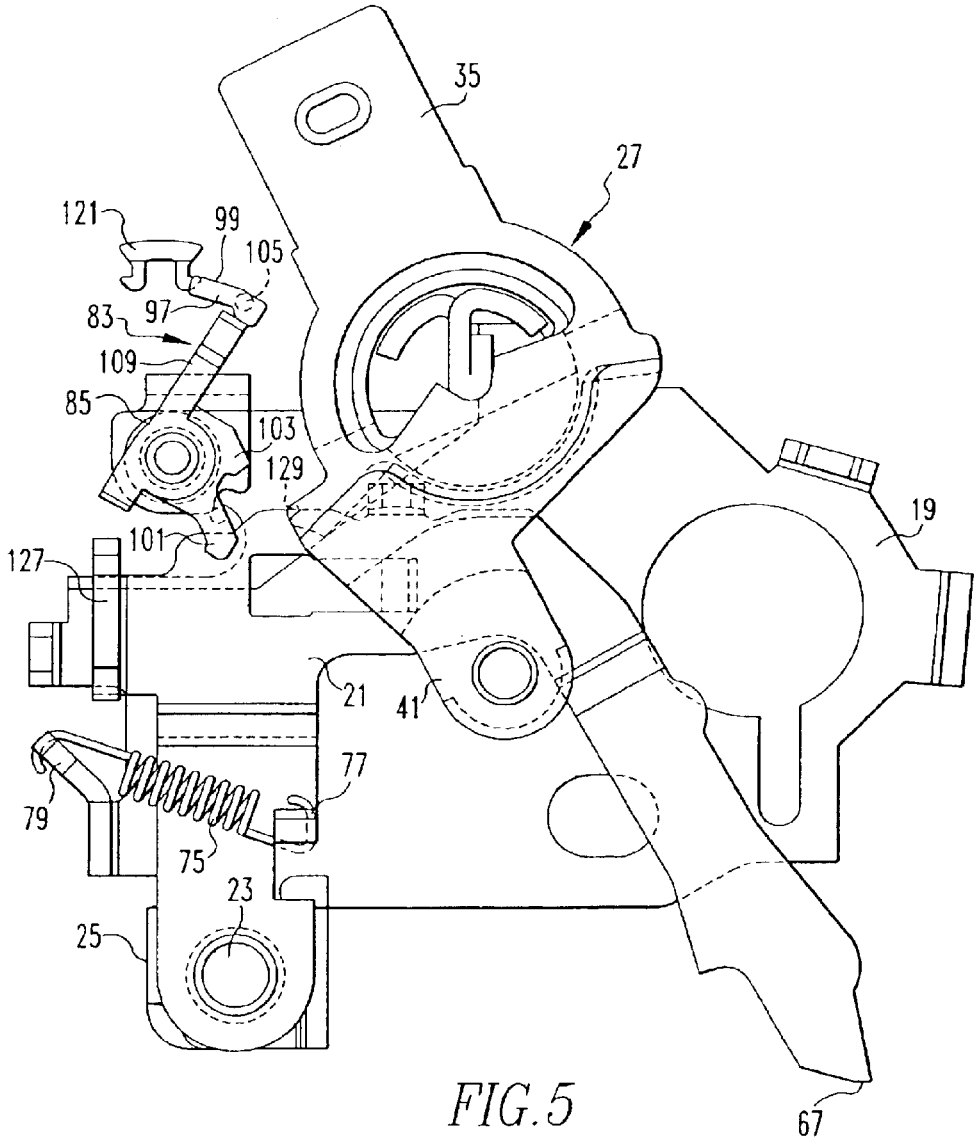
FIG. 5 is a simplified elevation view showing the circuit breaker in the on state and the trip indicator in the untripped position.

The operating mechanism 15 includes a cradle 21, which as can be clearly seen for instance in FIG. 5, is generally U-shaped. One end of the cradle is pivotally mounted by a pin 23 on the metal frame 19 and secured in place by a bendable flange 25. The operating mechanism 15 further includes a molded operating member 27, best seen in FIG. 3, having a through opening 29 with a partially cylindrical surface 31 that pivotally supports the operating member on a pair of complimentary tabs 33 (see FIG. 1) of the metal frame 19. An integral handle 35 on the operating member 27 protrudes through a handle opening 37 in the housing 3.

The operating mechanism 15 also includes a contact arm 39 carrying the movable contact 13 at a lower end. The upper end of the contact arm 39 is pinned to an extension 41 on the operating member 27. An operating spring 43 in the form of a helical tension spring is stretched between a flange 45 at a midpoint on the contact arm 39 and a tab 47 on the cradle 21.

The trip mechanism 17 is the known thermal/magnetic trip mechanism that includes a bimetal 49 fixed at an upper end to a tab 51 on the metal frame 19. A first flexible conductor 53 electrically connects this upper end of the bimetal 49 to the contact arm 39. The lower, free end of the bimetal 49 is connected by a second flexible conductor 55 to a load conductor 57, which in turn is connected to a load terminal 59. This bimetal 49 performs the thermal trip function of the trip mechanism 17. The magnetic trip function is performed by an armature 61 secured to the free end of the bimetal 49 by a leaf spring 63. The armature has an opening forming a latch ledge 65 which is engaged by a latch surface 67 on the second end of the cradle 21. A pole piece 69 carried by the bimetal 49 focuses the magnetic field generated by current passing through the bimetal 49 toward the armature 61.

The fixed contact 11 is mounted on a line conductor 71 which terminates in a clamp type line terminal 73. With the cradle 21 latched on the latch ledge 65 of the armature 61 and with the handle 35 in the on position, as shown in FIG. 1, the operating spring 43 rotates the contact arm 39 clockwise as shown in FIG. 1 to a closed state in which the movable contact 13 engages the fixed contact 11 to complete an electrical circuit from the line terminal 73, through the line conductor 71, the pair of contacts 9, the contact arm 39, the first flexible conductor 53, the bimetal 49, the load conductor 57 to the load terminal 59. The circuit breaker can be opened manually by moving the operating member 27, by the handle 35, clockwise to an off position. This moves the pivot point at the upper end of the contact arm 39 to the left, as viewed in FIG. 1, of the line of force of the operating spring 43, which in turn pulls the contact arm counterclockwise to open the pair of contacts 9.

The circuit breaker 1 is manually closed by rotating the operating member 27, through the handle 35, counterclockwise as viewed in FIG. 1 with the cradle 21 in the latched position. This moves the pivot point at the upper end of the contact arm 39 to the right of the line of force of the operating spring 43 so that the contact arm is pulled by the spring 43 to the closed position.

The circuit breaker 1 can be tripped open in response to either an overload or overcurrent condition. A persistent current above the rated current of the circuit breaker heats up the bimetal 49 resulting in deflection of the lower, free end to the right, as viewed in FIG. 1. When the predetermined current/time overload condition is reached, the latch ledge 65 on the armature 61 is pulled away from the latch surface 67 on the cradle 21. With the cradle unlatched, the operating spring 43 rotates the cradle clockwise so that the line of force of the operating spring is moved to the right of the pivoted upper end of the contact arm 39. This results in rotation of the contact arm 39 counterclockwise to the open position and the rotation of the handle 35 clockwise to the off position.

In a similar manner, an overcurrent flowing through the bimetal 49 generates a magnetic field of sufficient strength to attract the armature 61 toward the pole piece 69 resulting in disengagement of the latch surface 67 on the cradle 21 from the latch ledge 65. Rotation of the cradle 21 clockwise to the unlatched position results in movement of the contact arm to the open position. In response to a very high overcurrent, such as would be caused by a short circuit, extremely high repulsion forces between the contacts 11 and 13 are generated that blow the contacts open and rotate the contact arm counterclockwise before the trip mechanism fully responds to unlatch the cradle 21. Eventually, however, the cradle is unlatched and the handle is moved to the off position.

The exemplary circuit breaker 1 is provided with a reset spring 75 that relatches the cradle after a trip. As can be seen in FIG. 1, the helical tension reset spring 75 is connected between a tab 77 on the cradle 21 and a flange 79 on the metal frame 19. With the handle 35 in the off position and the contact arm open following a trip, the operating spring 43 is relaxed, but the reset spring is stretched by the clockwise rotation of the cradle 21. Thus, the reset spring 75 rotates the cradle 21 counterclockwise to reset the latch surface 67 on the cradle on the latch ledge 65 of the armature 61.

Figure 2:
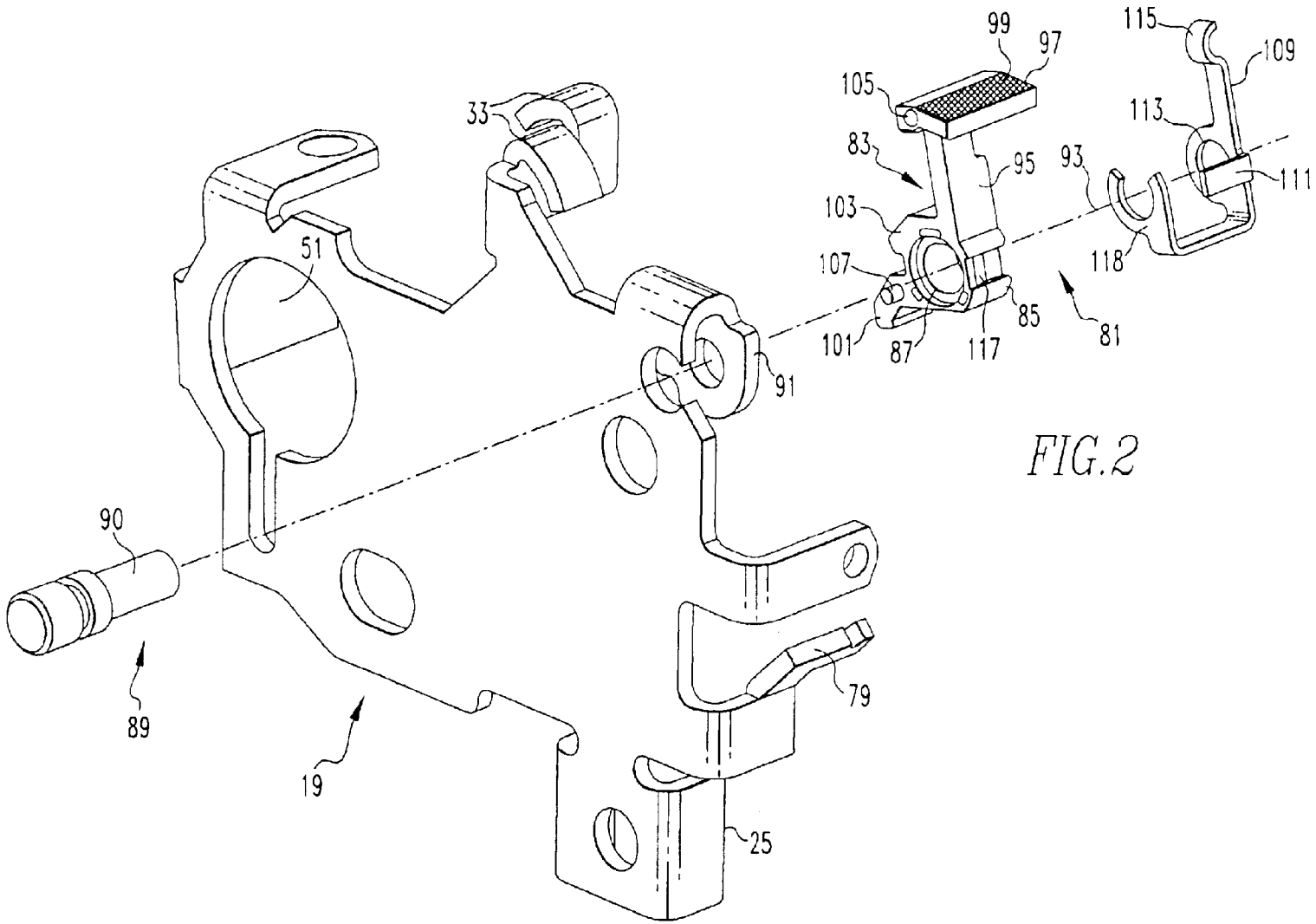
FIG. 2 is an exploded isometric view of the trip indicator, indicator spring and circuit breaker frame.

The circuit breaker 1 in accordance with the invention incorporates a trip indicator 81, which includes a trip indicating member 83. As best seen in FIG. 2, the trip indicating member 83 has a hub 85 with an out of round through opening 87. An indicator mount 89 includes a pivot pin 90 captured by the metal frame 19 and an integral flange 91, which engages the out of round opening 87 to pivotally mount the trip indicating member 83 for reciprocal rotation about a pivot axis 93. A leg 95 extending upward from the hub 85 supports a flag 97 which may carry on its upper surface indicia 99 such as red paint or other visual indication of a trip condition, including but not limited to the word "TRIPPED" or letter "T". An actuating finger 101 extends outward and downward from the hub. A boss 103 extends laterally outward from the hub 85 between the leg 95 and the actuating finger 101 for a purpose to be explained. A button 105 is provided on the side of the flag 97. An integral pin 107 extends laterally from the actuating finger 101 generally parallel to the pivot axis 93. The trip indicator further includes two springs: an indicator spring 109 and a blow open spring 111 integrally formed with a spring hub 113. The spring hub 113 seats on the pivot pin 89 with the leaf-type indicator spring 109 extending upward along side the leg 95 and terminating a bend 115 that bears against the upper end of the leg 95 just below the flag 97 and biases the trip indicating member 83 along the pivot axis 93. The blow open spring 111 extends laterally outward from the spring hub 13 and then axially to engage an axial slot 117 in the hub 85 of the trip actuating member 83. An integral clamp 118 extends from the bottom of the spring hub 113.

Figure 4:
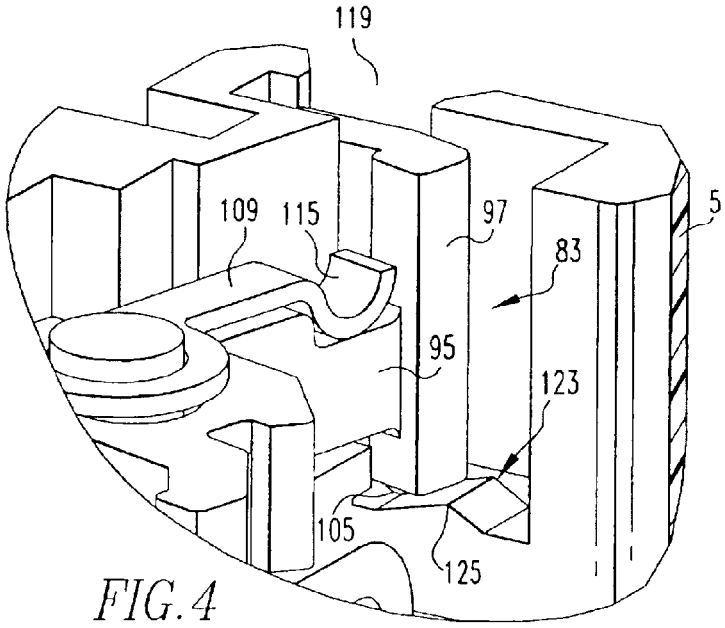
FIG. 4 is an isometric fragmentary view of the upper left corner of the circuit breaker shown in FIG. 1 rotated into a horizontal plane to show biasing of the indicator flag by the indicator spring.
Figure 7:
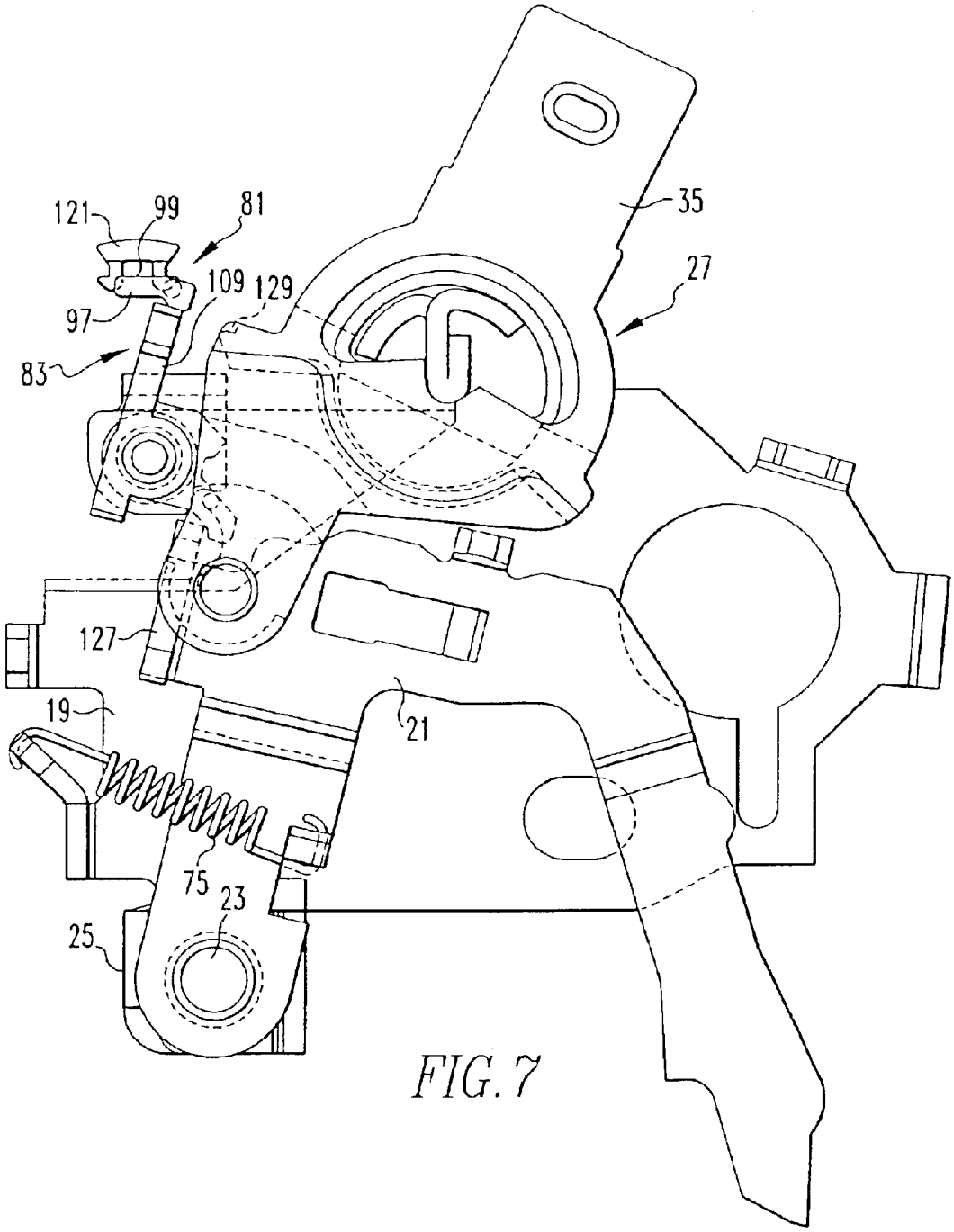
FIG. 7 is a view similar to FIG. 5, but showing the parts in the tripped position before the cradle is automatically reset.

Returning to FIG. 1, the housing 3 has a trip indicator window 119 formed by an opening in the base 5. A lens 121 may be provided in the window 119. The trip indicating member 83 is pivotally mounted for rotation between a tripped position (see FIG. 7) in which the flag 97 and the indicia 99 thereon are visible from outside of the circuit breaker 1 through the lens 121 in the window 119 and an untripped position (FIGS. 1 and 5) in which the flag 97 and indicia 99 are not visible through the window. As shown in the fragmentary view of FIG. 4, molded into the base 5 adjacent the window 119 is a cam surface 123 having an intermediate point 125 that protrudes axially toward the trip indicating member 83 and recedes in the lateral direction toward the tripped and untripped positions. The indicator spring 109 biases the trip indicating member, through the button 105 (to reduce friction), against this cam surface 123. Thus, the trip indicating member 83 snaps between the tripped and untripped positions as it passes the intermediate point 125 on the cam surface 123.

Figure 6:
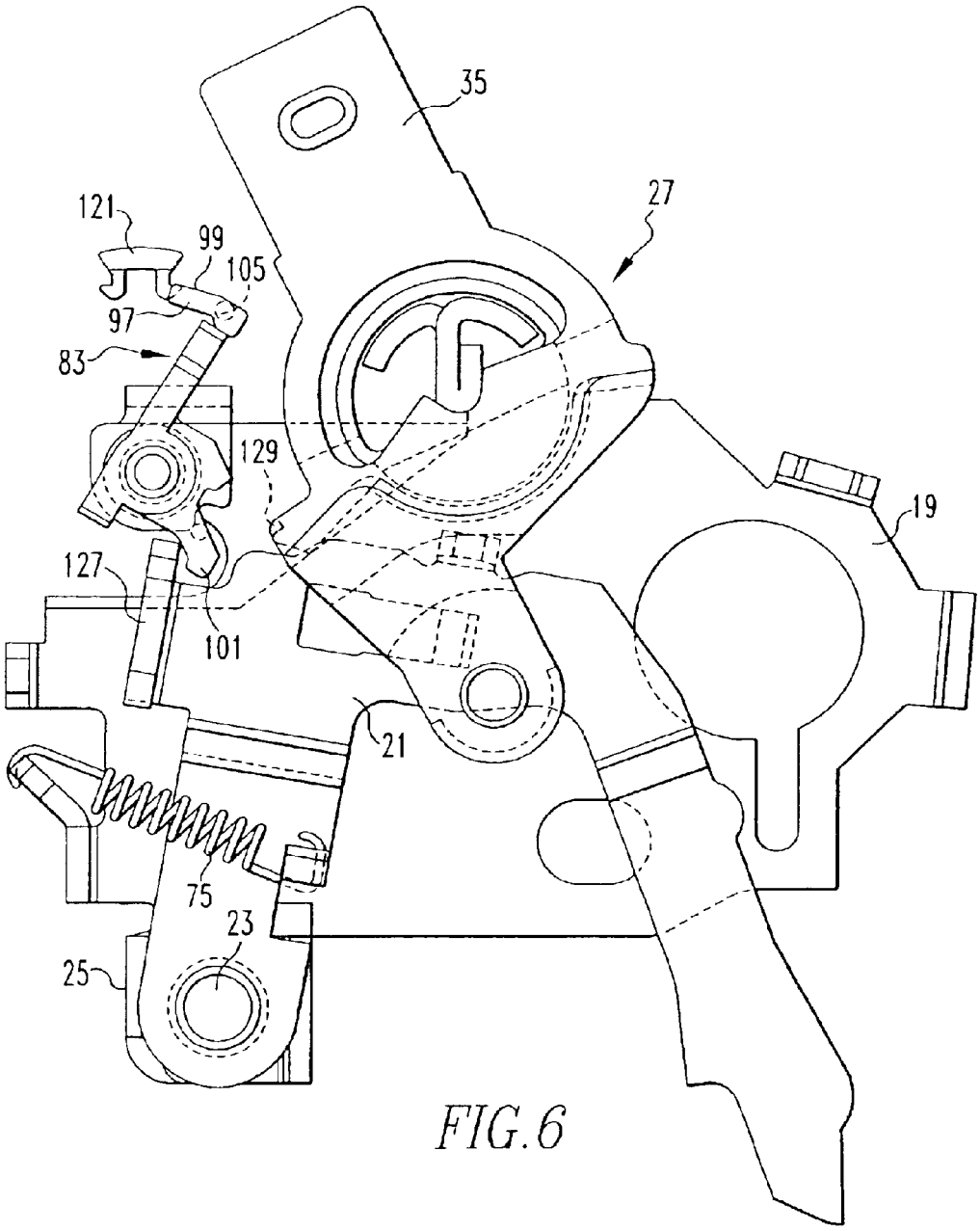
FIG. 6 is a view similar to FIG. 5 but showing initial engagement of the trip indicator as the cradle rotates during a trip.

As shown in FIG. 5, with the cradle 21 latched and the handle 35 in the closed position to close the circuit breaker, the trip indicating member 83 is in the untripped position (the flag 97 is not aligned with the lens 121 in the window 119). When the circuit breaker 1 is tripped and the unlatched cradle 21 begins to rotate clockwise, as shown in FIG. 6, an engagement surface formed by a flange 127 on the cradle engages the actuating finger 101 on the trip indicating member 83 and rotates it counterclockwise to the tripped position shown in FIG. 7, which also shows the handle 35 rotated to the tripped position. As described above, the cradle 21 is relatched by the reset spring 75 to the position shown in FIG. 8 where the flange 127 on the cradle is disengaged from the actuating finger 101 on the trip indicating member 83. However, the trip indicating member 83 remains in the tripped position with the indicia 99 showing through the lens 121 because the indicator spring 109 biases the button 105 to the trip position on the cam surface 123 (see FIG. 4).

Figure 8:
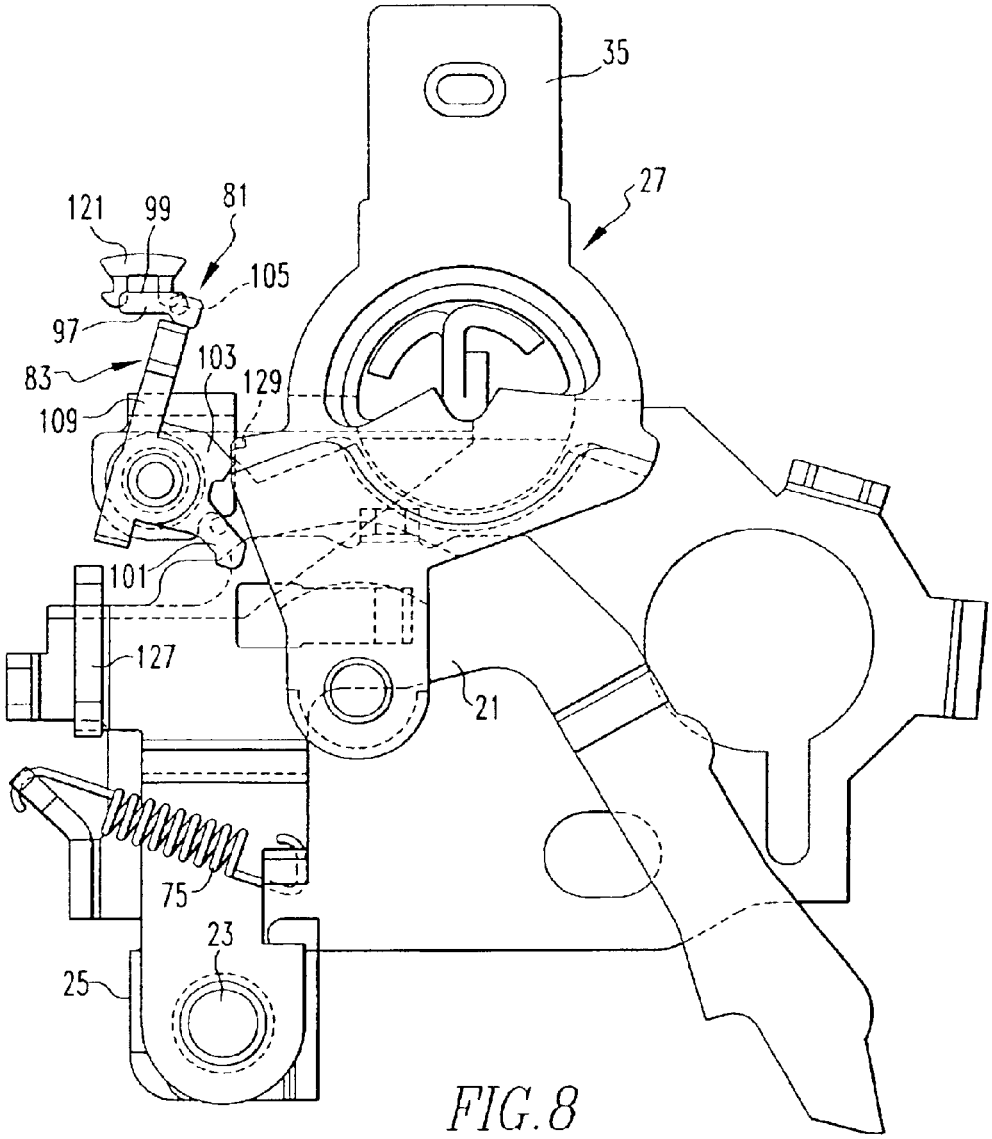
FIG. 8 is a view similar to FIG. 5, but showing the cradle automatically reset after a trip and the operating member engaging the trip indicator to return it to the untripped position as the handle is rotated to the on state.

As the circuit breaker 1 is reset by moving the handle 35 counterclockwise from the off to the on position, as shown in FIG. 8, a reset member in the form of a protrusion 129 (see FIG. 3) on the operating member 27 contacts the lateral projection formed by the boss 103 on the trip indicating member 83 and rotates it clockwise to the untripped position. As the button 105 on the flag 97 passes the intermediate point 125 on the cam surface 123 (see FIG. 4), the indicator spring 109 snaps the flag 97 to, and holds it in, the untripped position.

When the contacts 9 are blown open in response to a very high overcurrent such as a short circuit, the operating member 27, including the handle 35, which is coupled to the upper end of the contact arm 39, is rotated by the contact arm toward the off position. However, as the trip mechanism 17 has not yet responded to the short circuit, the cradle 21 remains momentarily latched and the trip indicator remains in the untripped position. This condition causes an interference between the projection 129 on the operating member 27 and the reset boss 103 on the trip indicating member. The out-of-round through opening 87 in the trip indicating member 83 allows the trip indicating member to be displaced transversely to the pivot axis 93 by the projection 129 against the bias of the blow open spring 111 as the operating member 27 rotates from the on to the off position. The blow open spring 111 then biases the trip indicating member back into the normal position. The trip mechanism 17 subsequently unlatches the cradle 21, which rotates clockwise to, as described above, set the trip indicator 83 to the tripped position.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker comprising:

a housing;

a pair of contacts comprising a fixed contact and a movable contact;

an operating member pivotally mounted for movement between a closed position and an open position and having a handle extending outside the housing;

a contact arm carrying the movable contact at a first end and coupled to the operating member at a second end;

a trip mechanism comprising a thermal/magnetic trip device having a tripped state and an untripped state;

a cradle pivotally mounted for movement between a latched position in which the cradle is retained by the trip mechanism in the untripped state, and an unlatched position to which the cradle moves when the trip mechanism goes to the tripped state;

an operating spring between the cradle and the contact arm biasing the contact arm to a closed state in which the movable contact engages the fixed contact when the operating member is in the closed state and the cradle is latched, and otherwise biasing the contact arm to an open state in which the pair of contacts are separated; and a trip indicator comprising:

an indicator window in the housing;

a trip indicating member carrying a trip indicia; and an indicator mount mounting the trip indicating member for movement between a tripped position in which the trip indicia is visible through the indicator window and an untripped position in which the trip indicia is not visible through the indicator window;

the cradle having an engagement member engaging the trip indicating member and moving the trip indicating member to the tripped position as the cradle moves to the unlatched position; and the operating member having a reset member engaging and moving the trip indicating member to the untripped position as the operating member is moved to the closed position.

2. The circuit breaker of claim 1, wherein the trip indicator further comprises an indicator spring biasing the trip indicating member to the tripped position and to the untripped position.

3. The circuit breaker of claim 2, wherein the housing has a cam surface laterally adjacent to the trip indicating member against which the indicator spring biases the trip indicating member during movement between the tripped and untripped positions of the trip indicating member.

4. The circuit breaker of claim 3, wherein the cam surface protrudes laterally toward the trip indicating member at an intermediate point in movement of the trip indicating member and recedes laterally toward both the tripped position and the untripped position of the trip indicating member.

5. The circuit breaker of claim 4, wherein the indicator mount is a pivot mount defining a pivot axis about which the trip indicating member reciprocally pivots between the tripped position and the untripped position.

6. The circuit breaker of claim 5, wherein the indicator spring is a leaf spring mounted by the pivot mount and bearing laterally against the trip indicating member to bias the trip indicating member along the pivot axis against the cam surface.

7. The circuit breaker of claim 6, wherein the contact arm blows open to the open state before the trip mechanism moves to the tripped state and, therefore, while the cradle remains in the latched position in response to a short circuit, the pivot mount comprising a non-circular opening sized to allow the trip indicating member to be displaced transverse to the pivot axis when the operating member is moved to the open position.

8. The circuit breaker of claim 7, wherein the trip indicator further comprises a blow open spring compliantly opposing displacement of the trip indicating member transverse to the pivot axis.

9. The circuit breaker of claim 8, wherein the blow open spring is formed integrally with the leaf spring.

10. The circuit breaker of claim 9, wherein the pivot mount comprises a pivot pin and the trip indicating member has the non-circular opening through which the pivot pin extends, and the indicator spring has a spring hub with a circular opening sized to remain centered on the pivot pin, the leaf spring extending from the spring hub along a lateral face of the trip indicating member and the blow open spring extending from the spring hub with a cantilevered portion extending generally along the pivot axis and bearing against an axially extending edge of the trip indicating member.

11. The circuit breaker of claim 10, wherein the cradle has a reset spring returning the cradle to the latched position following a trip.

12. The circuit breaker of claim 4, wherein the cradle has a reset spring returning the cradle to the latched position following a trip.

13. The circuit breaker of claim 1, wherein the cradle has a reset spring returning the cradle to the latched position following a trip.

14. The circuit breaker of claim 13, wherein the indicator mount is a pivot mount defining a pivot axis about which the trip indicating member reciprocally pivots between the tripped position and the untripped position.

15. The circuit breaker of claim 14, wherein the contact arm blows open to the open state before the trip mechanism moves to the tripped state, and therefore, while the cradle remains in the latched position in response to a short circuit, the pivot mount comprising a non-circular opening sized to allow the trip indicating member to be displaced transversely to the pivot axis when the operating member is moved to the open position following the short circuit.

16. The circuit breaker of claim 15, wherein the trip indicator further includes a blow open spring compliantly opposing displacement of the trip indicating member transversely to the pivot axis.

17. The circuit breaker of claim 1, wherein the cradle comprises a sheet member with the engagement member formed by a laterally extending flange.

18. The circuit breaker of claim 17, wherein the trip indicating member has a finger engaged by the laterally extending flange as the cradle moves to the unlatched position.

19. The circuit breaker of claim 18, wherein the trip indicating member has a lateral projection engaged by the reset member of the operating member as the operating member is moved from the open position to the closed position.

20. The circuit breaker of claim 18, wherein the trip indicating member further comprises an indicator spring biasing the trip indicating member to the tripped position and to the untripped position.

21. The circuit breaker of claim 20 wherein the indicator mount comprises a frame on which the operating member is pivotally mounted and on which the trip indicating member is secured by the indicator spring.

* * * * *